US008271270B2

(12) United States Patent
Lee et al.

(10) Patent No.: US 8,271,270 B2
(45) Date of Patent: Sep. 18, 2012

(54) METHOD, APPARATUS AND SYSTEM FOR ENCODING AND DECODING BROADBAND VOICE SIGNAL

(75) Inventors: In-sung Lee, Daejeon-si (KR); Jong-hark Kim, Cheongju-si (KR); Gyu-hyeok Jeong, Daejeon-si (KR); Sang-won Seo, Daejeon-si (KR)

(73) Assignees: Samsung Electronics Co., Ltd., Suwon-si (KR); Chungbuk National University Industry-Academic Cooperation Foundation, Cheongju (KR)

( * ) Notice: Subject to any disclaimer, the term of this patent is extended or adjusted under 35 U.S.C. 154(b) by 938 days.

(21) Appl. No.: 11/838,268

(22) Filed: Aug. 14, 2007

(65) Prior Publication Data

US 2008/0126084 A1 May 29, 2008

(30) Foreign Application Priority Data

Nov. 28, 2006 (KR) ..... 10-2006-0118546

(51) Int. Cl.
*G10L 19/02* (2006.01)
*G10L 19/00* (2006.01)

(52) U.S. Cl. ..... 704/203; 704/219; 704/500

(58) Field of Classification Search ..... 704/203, 704/219, 500

See application file for complete search history.

(56) References Cited

U.S. PATENT DOCUMENTS 5,596,676 A * 1/1997 Swaminathan et al. ..... 704/208
5,630,011 A * 5/1997 Lim et al. ..... 704/205
5,657,422 A * 8/1997 Janiszewski et al. ..... 704/229
5,765,130 A * 6/1998 Nguyen ..... 704/233
6,278,971 B1 * 8/2001 Inoue et al. ..... 704/205
6,810,273 B1 * 10/2004 Mattila et al. ..... 455/570
2001/0023395 A1 * 9/2001 Su et al. ..... 704/220
2002/0120445 A1 * 8/2002 Vafin et al. ..... 704/241
2003/0009332 A1 * 1/2003 Heusdens et al. ..... 704/240
2003/0187635 A1 10/2003 Ramabadran et al.

(Continued)

FOREIGN PATENT DOCUMENTS

JP 2002149198 A 5/2002

(Continued)

OTHER PUBLICATIONS

Etemoglu et al. Matching Pursuits Sinusoidal Speech Coding, Sep. 2003, IEEE Transactions on Speech and Audio Processing, vol. 11, No. 5, pp. 413-424.*

(Continued)

*Primary Examiner* — Eric Yen
(74) *Attorney, Agent, or Firm* — Sughrue Mion, PLLC

(57) ABSTRACT

A method, apparatus, and system for encoding or decoding a broadband voice signal are provided. The method includes extracting a linear prediction coefficient (LPC) from the broadband voice signal; outputting a linear prediction (LP) residual signal; pitch-searching a spectrum of the LP residual signal; extracting spectral magnitudes and phases of the LP residual signal, which correspond to a damping factor; obtaining, from among the extracted spectral magnitudes and phases, a first spectral magnitude and a first phase at which a power value of the LP residual signal is minimized; quantizing the first spectral magnitude and the first phase; and decoding the broadband voice signal. The apparatus includes a linear prediction coefficient (LPC) analyzer; an LPC inverse filter; a pitch searching unit; a sinusoidal analyzer; and a phase and spectral magnitude quantizer. The system includes a broadband voice encoding apparatus and a broadband voice decoding apparatus.

24 Claims, 6 Drawing Sheets

U.S. PATENT DOCUMENTS

| | | | | |
|---|---|---|---|---|
| 2005/0137858 | A1* | 6/2005 | Heikkinen et al. | 704/205 |
| 2006/0015328 | A1* | 1/2006 | Van Schijndel et al. | 704/219 |
| 2006/0149538 | A1* | 7/2006 | Lee et al. | 704/219 |
| 2006/0217975 | A1* | 9/2006 | Sung et al. | 704/228 |
| 2006/0277039 | A1* | 12/2006 | Vos et al. | 704/219 |
| 2008/0097763 | A1* | 4/2008 | Van De Par et al. | 704/500 |
| 2008/0275709 | A1* | 11/2008 | Den Brinker et al. | 704/500 |
| 2008/0312914 | A1* | 12/2008 | Rajendran et al. | 704/207 |
| 2009/0138271 | A1* | 5/2009 | Christensen et al. | 704/500 |

FOREIGN PATENT DOCUMENTS

| | | | |
|---|---|---|---|
| JP | 2002-261622 | A | 9/2002 |
| JP | 2006-171776 | A | 6/2006 |

OTHER PUBLICATIONS

Mallet et al, Matching Pursuits with Time-Frequency Dictionaries, Dec. 1993, IEEE Transactions on Signal Processing, vol. 41, No. 12, pp. 3397-3415.*

Lee, Is, Matching Pursuit Sinusoidal Modeling with Damping Factor, Journal of the Institute of Electronic Engineers of Korea, vol. 44 No. 1, pp. 105-113, Jan. 31, 2007, Korea, Republic of.

Chinese Office Action issued in corresponding application No. 200780044020.7 on May 20, 2011.

Office Action issued on Nov. 25, 2011 by the State Intellectual Property Office of the P.R. of China in the corresponding Chinese Patent Application No. 200780044020.7.

* cited by examiner

METHOD, APPARATUS AND SYSTEM FOR ENCODING AND DECODING BROADBAND VOICE SIGNAL

CROSS-REFERENCE TO RELATED PATENT APPLICATION

This application claims priority from Korean Patent Application No. 10-2006-0118546, filed on Nov. 28, 2006, in the Korean Intellectual Property Office, the disclosure of which is incorporated herein in its entirety by reference.

BACKGROUND OF THE INVENTION

1. Field of the Invention

Methods, apparatuses, and systems consistent with the present invention relate to encoding and decoding a broadband voice signal, and more particularly, to encoding and decoding a broadband voice signal using a matching pursuit sinusoidal model to which a damping factor is added.

2. Description of the Related Art

The variety of application fields of voice communication and an increase in the data transmission rates of networks have resulted in an increase in the demand for high-quality voice communication. In order to meet the need for high-quality voice communication, a broadband voice signal having 50-7000 Hz bandwidth needs to be transmitted, which has superior performance in various aspects, such as naturalness and clarity, compared to an existing telephone band of 300-3400 Hz, and in order to effectively compress the broadband voice signal, the development of a new broadband voice compressor is desirable.

In particular, digital communication uses a packet switching method for integrating voice communication and data communication. However, the packet switching method may cause channel congestion, resulting in packet loss and inferior sound quality. Although a technique of hiding a damaged packet may be used in order to address these problems, this technique is not a long term solution to these problems. Thus, recent voice compressors have tried to address these problems by reducing traffic using an extension function.

The extension function allows optimal communication to be performed in a given channel environment by forming voice data in various stages and adjusting the amount of a stage transmitted according to a level of congestion when the voice data is packetized. The extension function is used for voice communication by means of a packet network and can provide optimal communication according to a network state. Moreover, if the extension function is provided when a voice packet is transmitted via channels having different bit rates, tandem-free communication, by which the voice packet is transmitted by adjusting a transmission stage without using double coding, can be performed.

Thus, research regarding voice encoding and decoding with the extension function has been conducted, and in more detail, a 16-bit linear Pulse Code Modulation (PCM) format voice signal is encoded and decoded using a sinusoidal synthesis model. A sinusoidal model is an efficient technique of encoding a voice signal at a low bit rate, and is recently being used for voice conversion, sound quality improvement, and low data rate audio coding. The sinusoidal model is used in the field of digital signal processing, where analysis and synthesis is performed on a video signal, a bio-signal, or the like, due to robustness to background noise and non-voice signals.

However, in a related art sinusoidal model used for modeling a voice signal, it is assumed that a sinusoidal parameter is constant in an integer multiple of a fundamental frequency in a single frame. Due to this assumption, when a voice signal having a time varying characteristic is synthesized by a decoder end, the time varying characteristic is distorted, and discontinuity between frames occurs. In order to address these problems, the decoder end uses a parameter interpolation method or a waveform interpolation method. However, the parameter interpolation method or the waveform interpolation method causes modification of a voice waveform, resulting in distortion of a waveform during a non-stationary period. In particular, a significant decrease in sound quality occurs due to distortion of a waveform in the voice signal in an onset or offset transition duration.

In addition, a related art harmonic coding method that has been used by voice encoders having a low transmission rate detects a harmonic magnitude using a peak detection method for making a zero phase and performing Fast Fourier Transformation (FFT) in order to prevent phase transmission. However, the related art harmonic coding method has the limitation that a frequency resolution of less than 512 points must be applied due to restrictions of complexity and on data rate. A decrease of the frequency resolution and a transmission restriction of a phase parameter obstruct correct harmonic peak detection, and as a result, the performance of a voice encoder decreases due to delays in pulse positions of a synthesized voice signal and phase differences between frames.

SUMMARY OF THE INVENTION

Exemplary embodiments of the present invention provide a method and apparatus for encoding a broadband voice signal and supporting Signal-to-Noise Ratio (SNR) expendability with good performance by improving an existing sinusoidal model and reducing a quantization error in order to encode the broadband voice signal.

According to an aspect of the present invention, there is provided a method of encoding and decoding a broadband voice signal, the method comprising extracting a linear prediction coefficient (LPC) from the broadband voice signal; outputting a linear prediction (LP) residual signal obtained by removing an envelope from the broadband voice signal using the LPC; pitch-searching a spectrum of the LP residual signal; extracting spectral magnitudes and phases of the LP residual signal, the spectral magnitudes and phases corresponding to a damping factor, by adding the damping factor to a matching pursuit algorithm; obtaining a first spectral magnitude and a first phase, at which a power value of the LP residual signal is minimized, from among the extracted spectral magnitudes and phases; quantizing the first spectral magnitude and the first phase; and decoding the broadband voice signal.

The damping factor may comprise a spectral magnitude damping factor and a frequency damping factor of the LP residual signal.

The extracting of the spectral magnitudes and phases of the LP residual signal may comprise setting a plurality of candidate frequencies with respect to each frequency obtained by pitch-searching the LP residual signal using the frequency damping factor; calculating a sinusoidal dictionary value by obtaining a frequency and a phase, at which an error value is minimized, from among the candidate frequencies with respect to each frequency obtained by pitch-searching, and accumulating the sinusoidal dictionary value calculated with respect to each frequency obtained by pitch-searching; generating a final residual signal by subtracting the accumulated sinusoidal dictionary value from a target signal, which is the LP residual signal; and detecting a frequency damping factor corresponding to the first spectral magnitude and the first phase at which a power value of the final residual signal is minimized with respect to each frequency obtained by pitch-searching.

The setting of the candidate frequencies may comprise setting the candidate frequencies between a frequency corresponding to (n−1) times a fundamental frequency and a frequency corresponding to (n+1) times the fundamental frequency using the frequency damping factor with respect to a frequency corresponding to n times the fundamental frequency in the LP residual signal.

The number of sinusoidal dictionaries accumulated may be equal to the number of spectra of the broadband voice signal.

The spectral magnitude damping factor may be obtained and quantized using the first spectral magnitude and the first phase.

The first spectral magnitude may be quantized using a Discrete Cosine Transformation (DCT).

A method of quantizing the first phase may comprise obtaining distances by obtaining differences between the first phase and first codebook phases generated from the first phase, multiplying the differences by an envelope value corresponding to the first phase, and adding each of the differences to the respective multiplication results; detecting and outputting a first codebook phase allowing the distance to be minimized; generating a second phase by adjusting a phase error vector generated from a difference between the first codebook phase and the first phase, and obtaining distances by obtaining differences between the second phase and second codebook phases generated from the second phase, multiplying the differences by an envelope value corresponding to the second phase, and adding the differences to the respective multiplication results; and detecting and outputting a second codebook phase allowing the distance to be minimized.

The damping factor, the spectral magnitude, the phase, and a pitch may be quantized by determining bit assignment by means of mode information according to various transmission rates.

The decoding of the broadband voice signal may comprise: decoding the quantized first spectral magnitude and the quantized first phase; decoding the quantized damping factor; synthesizing an LP residual signal using at least one of the first spectral magnitude, the first phase, the damping factor, and a pitch value; and decoding the broadband voice signal from the LP residual signal.

According to another aspect of the present invention, there is provided an apparatus for encoding a broadband voice signal in a broadband voice encoding system, the apparatus comprising a linear prediction coefficient (LPC) analyzer which extracts an LPC from the broadband voice signal; an LPC inverse filter which outputs a linear prediction (LP) residual signal obtained by removing an envelope from the broadband voice signal using the LPC; a pitch searching unit which pitch-searches a spectrum of the LP residual signal; a sinusoidal analyzer which extracts a spectral magnitude and phase of the LP residual signal, which correspond to a damping factor, by adding the damping factor to a matching pursuit algorithm, and obtains a first spectral magnitude and a first phase, at which a power value of the LP residual signal is minimized, from among the extracted spectral magnitude and phase; and a phase and spectral magnitude quantizer which quantizes the first spectral magnitude and the first phase.

The sinusoidal analyzer may comprise a frequency damping factor application unit which sets a plurality of candidate frequencies with respect to each frequency obtained by pitch-searching the LP residual signal using the frequency damping factor; an error minimization unit which obtains a frequency and a phase, at which an error value is minimized, from among the candidate frequencies with respect to each frequency obtained by pitch-searching; a dictionary component generator which obtains a sinusoidal dictionary value by means of the frequency and the phase output from the error minimization unit; an accumulator which receives the sinusoidal dictionary value generated with respect to each frequency obtained by pitch-searching the dictionary component generator and accumulates the sinusoidal dictionary value; a calculator which generates a final residual signal by subtracting the accumulated sinusoidal dictionary value from the LP residual signal; and a damping factor selector which detects a frequency damping factor corresponding to the first spectral magnitude and the first phase in which a power value of the final residual signal is minimized with respect to each frequency obtained by pitch-searching.

According to another aspect of the present invention, there is provided a broadband voice encoding and decoding system comprising a broadband voice encoding apparatus which obtains a linear prediction (LP) residual signal by removing an envelope from a broadband voice signal using a linear prediction coefficient (LPC) extracted from the broadband voice signal, extracts spectral magnitudes and phases of the LP residual signal, which correspond to a damping factor, by adding the damping factor to a matching pursuit algorithm, obtains a first spectral magnitude and a first phase, at which a power value of the LP residual signal is minimized, from among the extracted spectral magnitudes and phases, and quantizes the first spectral magnitude and the first phase; and a broadband voice decoding apparatus which decodes the broadband voice signal by decoding the quantized first spectral magnitude, the quantized first phase, and the quantized damping factor and synthesizing the LP residual signal.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF THE INVENTION

Figure 1:
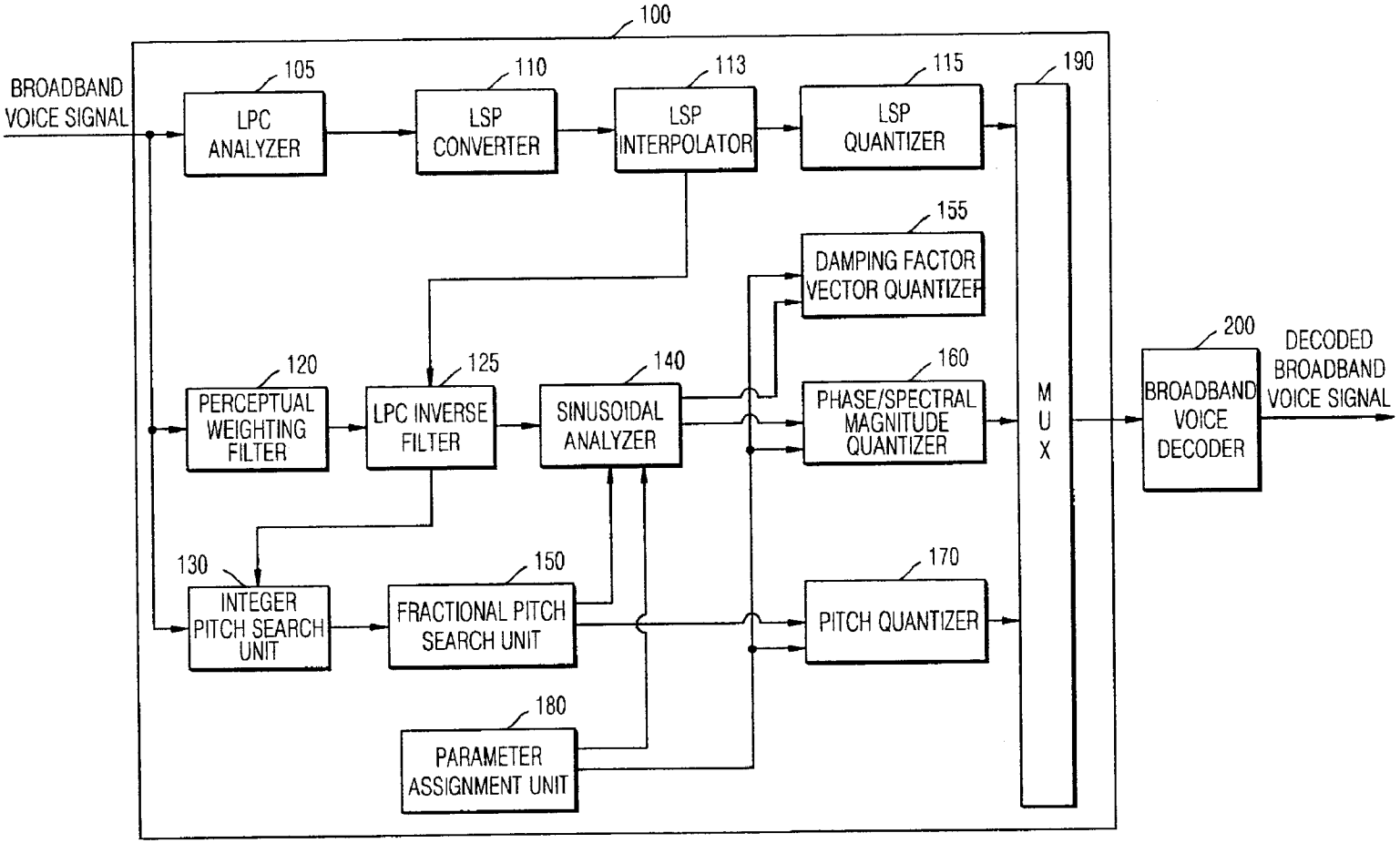
FIG. 1 is a block diagram of a broadband voice encoding and decoding system according to an exemplary embodiment of the present invention.

The attached drawings for illustrating exemplary embodiments of the present invention are referred to in order to gain a sufficient understanding of the present invention, the merits thereof, and the objectives accomplished by the implementation of the present inventive concept.

Hereinafter, the present inventive concept will be described in detail by explaining exemplary embodiments of the invention with reference to the attached drawings. In the drawings, like reference numerals in the drawings denote like elements.

FIG. 1 is a block diagram of a broadband voice signal encoding and decoding system according to an exemplary embodiment of the present invention.

Referring to FIG. 1, the broadband voice encoding and decoding system includes a broadband voice encoder 100 and a broadband voice decoder 200.

The broadband voice encoder 100 includes a Linear Prediction Coefficient (LPC) analyzer 105, a Line Spectral Pairs (LSP) converter 110, an LSP interpolator 113, an LSP quantizer 115, a perceptual weighting filter 120, an LPC inverse filter 125, an integer pitch search unit 130, a sinusoidal analyzer 140, a fractional pitch search unit 150, a damping factor vector quantizer 155, a phase/spectral magnitude quantizer 160, a pitch quantizer 170, a parameter assignment unit 180, and a multiplexer (MUX) 190.

A voice signal having a wide bandwidth of about 50 Hz to about 7000 Hz is input to the LPC analyzer 105, the perceptual weighting filter 120, and the integer pitch search unit 130 about every 20-ms (i.e., every frame). The LPC analyzer 105 outputs $16^{th}$ order LPC parameters using a self-correlation method with respect to the input signal to which a Hamming window is applied every frame.

The LSP converter 110 reduces a bit rate by converting the LPC parameters in a time domain to LSP parameters in a frequency domain. The LSP interpolator 113 interpolates past LSP values using two sub-frame LPC filters and outputs 2 pairs of LPCs for 2 sub-frames by converting the interpolated past LSP values to LPCs. The LSP quantizer 115 quantizes the LSP parameters.

The perceptual weighting filter 120 receives the broadband voice signal and LPCs including LPC parameters and modifies the broadband voice signal using the LPCs quantized to fit a perception characteristic of a human auditory sense. The LPC inverse filter 125 outputs a Linear Prediction (LP) residual signal obtained by removing an envelope from a spectrum. The LP residual signal is generated using the LPC signal output from the LSP interpolator 113.

The LP residual signal is used to determine a pitch, and the sinusoidal analyzer 140 performs sinusoidal modeling of the LP residual signal using a matching pursuit algorithm, wherein a damping factor is added to the sinusoidal modeling.

The sinusoidal analyzer 140 performs the modeling of the LP residual signal by setting a location, in which a spectral magnitude and phase of the broadband voice signal are multiples of those of a fundamental frequency, as a reference point, based on information input from the parameter assignment unit 180, and obtains a damping factor based on the modeling.

That is, the sinusoidal analyzer 140 receives the LP residual signal and models the LP residual signal using a matching pursuit sinusoidal model to which the damping factor is added. The phase/spectral magnitude quantizer 160 quantizes a spectral magnitude of the LP residual signal using a Discrete Cosine Transformation (DCT) and quantizes a phase of the LP residual signal using a circular characteristic. The phase/spectral magnitude quantizer 160 has a multi-stage structure.

In this case, the spectral magnitude is quantized by a quantizer (not shown) using DCT, the phase is quantized by a circular weighting quantizer (not shown), and the damping factor is quantized by a vector quantizer (not shown). A method used by the sinusoidal analyzer 140 to extract the damping factor will be described in detail with reference to FIG. 2 below, and the quantization of the spectral magnitude and phase analyzed by the sinusoidal analyzer 140 will be described in detail with reference to FIGS. 5 and 6 below.

The pitch search includes two stages of an integer pitch search and a fractional pitch search. That is, the integer pitch search unit 130 receives the LP residual signal and the broadband voice signal and obtains a peak period of the LP residual signal by performing an integer pitch search using self-correlation approximate values of Fast Fourier Transform (FFT) coefficient values. The fractional pitch search unit 150 performs a fine pitch search on a decimal point basis by obtaining a pitch value having the maximum cross-correlation value from among approximate values of pitch values.

The pitch search method uses an open-loop pitch search in which self-correlation approximate values are calculated using calculation values using a FFT. That is, a correct pitch value can be obtained by obtaining approximate pitch values using FFT and obtaining a pitch value having a maximum cross-correlation value from among the approximate pitch values. The pitch value is quantized by the pitch quantizer 170. The MUX 190 packetizes the spectral magnitude, the phase, the damping factor, and a codebook index of the pitch value.

The codebook index and a quantized code are input to the broadband voice decoder 200, and the broadband voice decoder 200 decodes the encoded broadband voice signal through an inverse process of the broadband voice encoder 100 and outputs the decoded broadband voice signal.

That is, the broadband voice decoder 200 synthesizes the LP residual signal using the quantized first spectral magnitude, the quantized first phase, the quantized damping factor, and the quantized pitch value and outputs the broadband signal by decoding the encoded broadband voice signal from the synthesized LP residual signal.

For a multi-stage broadband voice encoder, a fundamental stage is set to 8 Kbps, and encoding is performed by adding stages having data rates of 4 Kbps, 12 Kbps, and 8 Kbps to the fundamental stage.

Thus, the parameter assignment unit 180 determines parameter selection and bit assignment based on mode information according to a channel state, as illustrated in Table 1 below, and provides information on each detail of the parameter selection and bit assignment to the sinusoidal analyzer 140, the damping factor vector quantizer 155, the phase/spectral magnitude quantizer 160, and the pitch quantizer 170.

Each stage provides detail information to the fundamental stage by modeling frequencies adjacent to a fundamental frequency in the damping factor added sinusoidal model.

Table 1 illustrates bit assignment according to parameters of 32 Kbps, 24 Kbps, 12 Kbps, and 8 Kbps modes.

TABLE 1

| Mode | Parameter | 1st subframe | 2nd subframe | total per frame |
|---|---|---|---|---|
| 32 kbit/s | Mode | | | 2 |
| | LSP | | | 46 |
| | Pitch delay | | | 30 |
| | Harmonic Magnitude | 100 | 100 | 200 |
| | Harmonic Phase | 40 | 40 | 80 |
| | Damping Factor | 15 | 15 | 30 |
| | Adding Harmonic Magnitude(4) | 90 | 90 | 180 |

TABLE 1-continued

| Mode | Parameter | 1st subframe | 2nd subframe | total per frame |
|---|---|---|---|---|
| | Adding Harmonic Phase(4) | 36 | 36 | 72 |
| | Total | | | 640 |
| 24 kbit/s | Mode | | | 2 |
| | LSP | | | 46 |
| | Pitch delay | | | 30 |
| | Harmonic Magnitude | 90 | 90 | 180 |
| | Harmonic Phase | 35 | 35 | 70 |
| | Damping Factor | 15 | 15 | 30 |
| | Adding Harmonic Magnitude(2) | 40 | 40 | 80 |
| | Adding Harmonic Phase(2) | 21 | 21 | 42 |
| | Total | | | 480 |
| 12 kbit/s | Mode | | | 2 |
| | LSP | | | 46 |
| | Pitch delay | 15 | 15 | 30 |
| | Harmonic Magnitude | 30 | 30 | 60 |
| | Harmonic Phase | 14 | 14 | 28 |
| | Damping Factor | 5 | 5 | 10 |
| | Adding Harmonic Magnitude(1) | 20 | 20 | 40 |
| | Adding Harmonic Phase(1) | 12 | 12 | 24 |
| | Total | | | 240 |
| 8 kbit/s | Mode | | | 2 |
| | LSP | | | 46 |
| | Pitch delay | 8 | 8 | 16 |
| | Harmonic Magnitude | 30 | 30 | 60 |
| | Harmonic Phase | 13 | 13 | 26 |
| | Damping Factor | 5 | 5 | 10 |
| | Total | | | 170 |

The sinusoidal modeling method using a matching pursuit algorithm, to which the damping factor is added by the sinusoidal analyzer 140, will now be described in more detail with reference to FIG. 2.

An exemplary embodiment of the present invention allows more efficient modeling by extracting two transmission parameters (a spectral magnitude damping factor $g_l^k$ and a frequency damping factor $c_l^k$) called 'damping factors' by granting simple constraint conditions to a general sinusoidal model. That is, since a voice signal varies with a correlation, which may be predetermined, between a current frame and a previous frame according to a characteristic of the voice signal, constraint conditions are granted to a correlation between voice samples.

The damping factor will now be described prior to the description of an exemplary embodiment of the present invention.

The damping factor denotes a ratio of a parameter of a current frame to a parameter of a previous frame, and a magnitude and a frequency of a spectrum between frames are represented by Equation 1.

$$A_l^k = g_l^k \cdot A_l^{k-1},\ w_l^k = c_l^k w_l^{k-1} \tag{1}$$

In Equation 1, $A_l^k$ and $w_l^k$ denote the magnitude and frequency of an $l^{th}$ spectrum of a $k^{th}$ frame, respectively. That is, damping factors of the current frame with respect to a spectral magnitude and frequency are represented by $g_l^k$ and $c_l^k$, respectively. A spectral magnitude and frequency analyzed using the matching pursuit sinusoidal model are parameter-interpolated in order to prevent discontinuity between frames, wherein the spectral magnitude is interpolated using a first line of Equation 2, shown below, and a phase is interpolated using a first line of Equation 3, shown below. Herein, a spectral magnitude synthesized by interpolating a spectral magnitude of the previous frame can be represented by a second line of Equation 2 using the spectral magnitude damping factor $g_l^k$, and a phase synthesized by interpolating a phase of the previous frame can be represented by a second line of Equation 3 using a phase change rate a of the spectrum and the frequency damping factor $c_l^k$.

$$\begin{aligned}\tilde{A}_l^k(n) &= \left(1 - \frac{n}{N}\right) \cdot A_l^k + \frac{n}{N} \cdot A_l^{k-1} \\ &= \left[1 + (1 - g_l^k) \cdot \frac{n}{N}\right] \cdot A_l^k\end{aligned} \tag{2}$$

$$\begin{aligned}\tilde{\theta}_l^k(n) &= \theta_l^k + w_l^k \cdot a \cdot n^2 \\ a &= \frac{w_l^{k+1} - w_l^k}{2N} = \frac{(c_l^k - 1) w_l^k}{2N}\end{aligned} \tag{3}$$

In Equations 2 and 3, N denotes a frame length. The value a denotes a phase change rate of a spectrum synthesized by performing $2^{nd}$ order interpolation of a phase of the spectrum of the previous frame and can be represented by Equation 3 using the frequency damping factor $c_l^k$.

Figure 2:
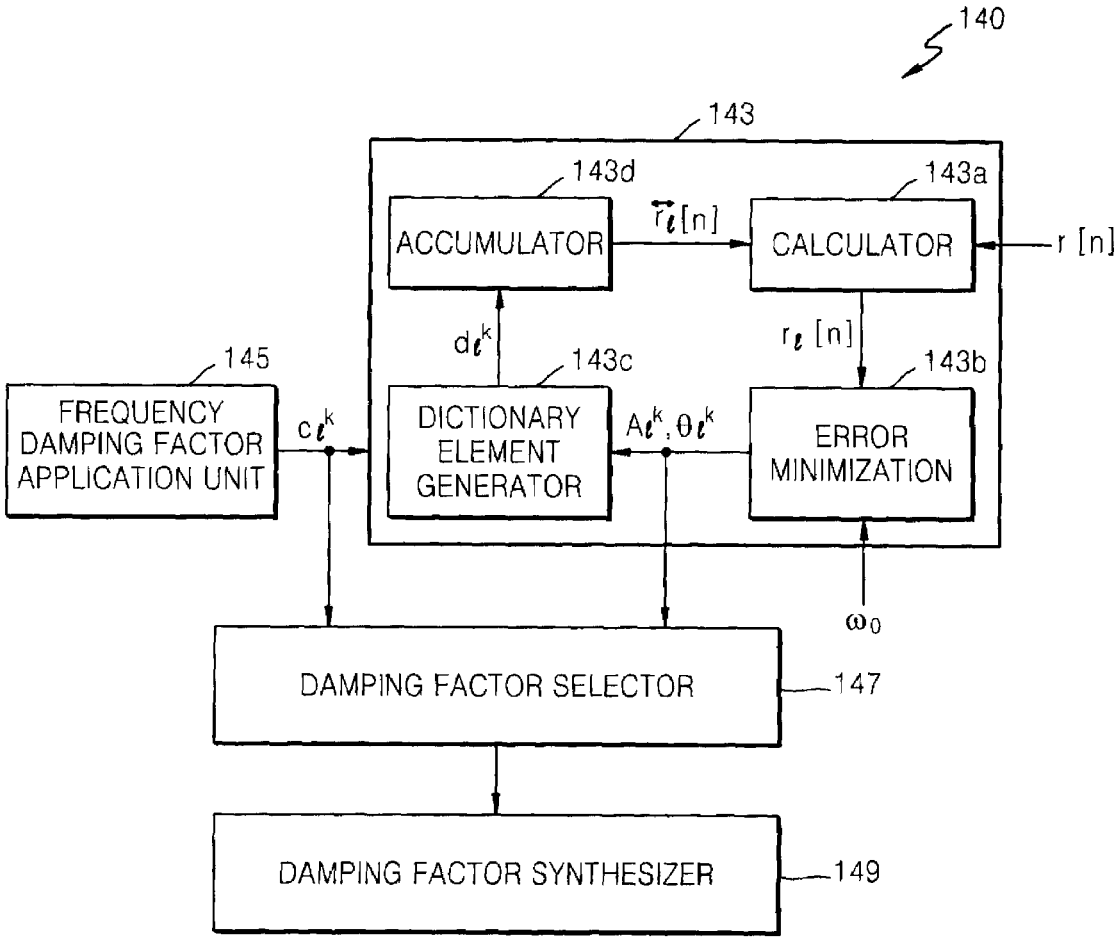
FIG. 2 is a block diagram of a sinusoidal analyzer according to an exemplary embodiment of the present invention.

FIG. 2 is a block diagram of the sinusoidal analyzer 140 according to an exemplary embodiment of the present invention.

Referring to FIG. 2, the sinusoidal analyzer 140 includes a sinusoidal magnitude/phase search unit 143, a frequency damping factor application unit 145, a damping factor selector 147, and a damping factor synthesizer 149.

Since the spectral magnitude and frequency damping factors are used instead of interpolation when synthesis is performed according to a characteristic of the matching pursuit sinusoidal model to which a damping factor is added, an additional windowing block is unnecessary.

A target signal r[n], which is the LP residual signal output from the LPC inverse filter 125 (shown in FIG. 1), is input to the sinusoidal magnitude/phase search unit 143, and a spectral magnitude and phase of the target signal r[n] are searched using a matching pursuit algorithm. That is, the sinusoidal magnitude/phase search unit 143 integrates interpolation methods used when parameters are predicted and synthesized using the matching pursuit sinusoidal model to which a damping factor is added.

The sinusoidal magnitude/phase search unit 143 includes a calculator block 143*a*, an error minimization block 143*b*, a dictionary element generator block 143*c*, and an accumulator block 143*d*, which are sequentially coupled to each other in a ring arrangement. The sinusoidal magnitude/phase search unit 143 detects a pair of a spectral magnitude and a phase corresponding to each candidate of the frequency damping factor $c_l^k$ input from the frequency damping factor application unit 145 by fixing the spectral magnitude damping factor $g_l^k$ to 1. Hereinafter, only a state where the frequency damping factor $c_l^k$ is fixed to an initial value, i.e., a portion in which detected frequencies are multiples of the fundamental frequency, will be described.

A first target signal r[n], which is the LP residual signal, is input to the calculator block 143*a* of the sinusoidal magnitude/phase search unit 143, and the calculator block 143*a* outputs a signal $r_l[n]$ corresponding to a difference between the first target signal r[n] and a signal $r_{l-1}[n]$ output from the accumulator block 143*d* as a new target signal to the error minimization block 143*b*.

In this case, a fundamental frequency $\omega_0$ detected from the pitch found by the integer pitch search unit 130 and the fractional pitch search unit 150 and the new target signal $r_l[n]$ are input to the error minimization block 143*b*.

The error minimization block 143*b* searches the magnitude and phase of a sinusoidal dictionary by means of Equation 4 using the new target signal $r_l[n]$.

$$E_l = \sum_{n=1}^{frame\ size} \left[r_l^k[n] - A_l^k \cos(\tilde{\theta}_l^k)\right]^2 \tag{4}$$

Here, $r_l$ denotes an $l^{th}$ target signal, and $E_l$ denotes a mean square error between $r_l$ and an $l^{th}$ sinusoidal dictionary. If l is 0, $r_l$ is equal to the LP residual signal. If it is assumed, as described above, that $g_l^k$ is 1, the synthesized spectral magnitude $\tilde{A}_l^k$ represented by Equation 2 is the same as the spectral magnitude $A_l^k$ of the current frame.

The error minimization block 143*b* obtains $A_l$ and $\theta_l$ in which the error $E_l$ is minimized using Equation 5 (shown below). That is, $A_l$ and $\theta_l$ in which the error $E_l$ is minimized are represented by Equation 5.

$$A_l = \sqrt{a_l^2 + b_l^2},\ \theta_l = -\tan^{-1}\left(\frac{b_l}{a_l}\right) \tag{5}$$

$$a_l = \frac{\sum_{n=0}^{frame\ size-1} \sin^2(\theta_l) \sum_{n=0}^{frame\ size-1} r_l(n)\cos(\theta_l) - \sum_{n=0}^{frame\ size-1} \cos(\theta_l)\sin(\theta_l) \sum_{n=0}^{frame\ size-1} r_l(n)\sin(\theta_l)}{\sum_{n=0}^{frame\ size-1} \cos^2(\theta_l) \sum_{n=0}^{frame\ size-1} \sin^2(\theta_l) - \sum_{n=0}^{frame\ size-1} \cos(\theta_l)\sin(\theta_l) \sum_{n=0}^{frame\ size-1} \cos(\theta_l)\sin(\theta_l)}$$

$$b_l = \frac{\sum_{n=0}^{frame\ size-1} \cos^2(\theta_l) \sum_{n=0}^{frame\ size-1} r_l(n)\sin(\theta_l) - \sum_{n=0}^{frame\ size-1} \cos(\theta_l)\sin(\theta_l) \sum_{n=0}^{frame\ size-1} r_l(n)\cos(\theta_l)}{\sum_{n=0}^{frame\ size-1} \cos^2(\theta_l) \sum_{n=0}^{frame\ size-1} \sin^2(\theta_l) - \sum_{n=0}^{frame\ size-1} \cos(\theta_l)\sin(\theta_l) \sum_{n=0}^{frame\ size-1} \cos(\theta_l)\sin(\theta_l)}$$

The error minimization block 143*b* determines $\theta_k$ according to a candidate value of the frequency damping factor $c_l^k$ and selects $A_l$ and $\theta_l$ in which the error $E_l$ is minimized. In this case, an initial value is used as $c_l^k$, and detected frequency points are multiples of the fundamental frequency.

As described above, the error minimization block 143*b* outputs $l^*w_0$, $A_l$, and $\tilde{\theta}_l$ corresponding to an $l^{th}$ spectrum to the dictionary element generator block 143*c*, and the dictionary element generator block 143*c* generates a sinusoidal dictionary $d_l^k$ represented by Equation 6.

$$d_l^k = A_l \cos \tilde{\theta}_l \tag{6}$$

In Equation 6, the sinusoidal dictionary $d_l^k$ may be a temporal waveform corresponding to an $l^{th}$ spectrum in a $k^{th}$ frame.

That is, the dictionary element generator block 143*c* generates the temporal waveform $d_l^k$ obtained by synthesizing only $l^{th}$ spectra in every frame in a time domain by means of output parameters.

The accumulator block 143*d* generates a synthesized signal $\tilde{r}_l[n]$ by linearly adding $d_l^k$, i.e., synthesis signals generated up to an $l^{th}$ synthesis signal, as illustrated in Equation 7.

$$\tilde{r}_l[n] = \sum_{n=0}^{frame\ size-1} \sum_{l=1}^{L} A_l(n)\cos(\theta_l(n)) \tag{7}$$

In Equation 7, L denotes an integer obtained by dividing a pitch by 2, i.e., the number of harmonics.

When the accumulator block 143*d* outputs the synthesized signal $\tilde{r}_l[n]$, the calculator block 143*a* generates the new target signal $r_l[n]$ by subtracting the synthesized signal $\tilde{r}_l[n]$ from the target signal r[n]. Finally, the sinusoidal magnitude/phase search unit 143 synthesizes spectral magnitudes and phases detected from frequencies that are multiples of the fundamental frequency.

The damping factor selector 147 obtains a power value of a final residual signal according to each frequency, selects an optimal parameter corresponding to the minimum power value, and outputs the optimal parameter to the damping factor synthesizer 149.

The damping factor synthesizer 149 synthesizes the LP residual signal using optimal parameters obtained by repeating the matching pursuit algorithm.

The matching pursuit algorithm according to an exemplary embodiment of the present invention will now be described in more detail with reference to FIGS. 2 through 4B.

Figure 3A:
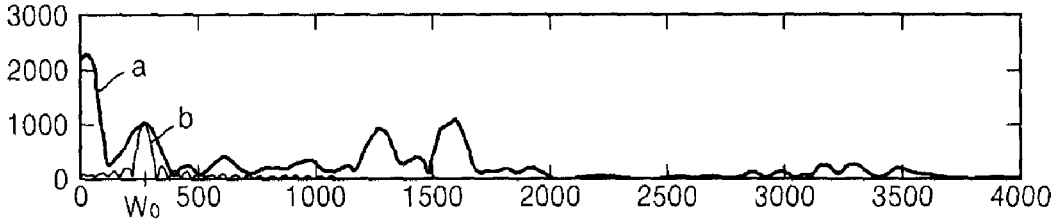
FIGS. 3A and 3B are graphs illustrating a signal waveform and magnitude when a sinusoidal magnitude and phase search unit according to an exemplary embodiment of the present invention has firstly operated its internal blocks in a ring arrangement.
Figure 3B:
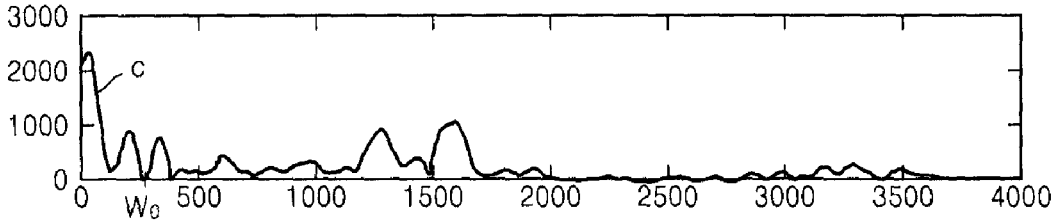

FIGS. 3A and 3B are graphs illustrating a signal waveform and magnitude when the sinusoidal magnitude/phase search unit 143 according to an exemplary embodiment of the present invention has firstly operated its internal blocks in a ring arrangement.

FIG. 3A illustrates the magnitude of the target signal r[n] indicated by the character a, which is the LP residual signal, and the magnitude of a first synthesized signal $\tilde{r}_l[n]$ indicated by the character b, which is output from the accumulator block 143*d*, in a frequency domain according to an exemplary embodiment of the present invention. FIG. 3B illustrates the magnitude of a new target signal $r_1[n]$ indicated by the character c, which is generated by subtracting the synthesized signal $\tilde{r}_l[n]$ from the target signal r[n], in the frequency domain according to an exemplary embodiment of the present invention.

The first target signal r[n], which is the LP residual signal, is input to the calculator block 143*a* of the sinusoidal magnitude/phase search unit 143 and provided to the error minimization block 143*b*. At the same time, the fundamental frequency $w_0$ is input to the error minimization block 143*b* by the pitch search.

The error minimization block 143*b* obtains a sinusoidal magnitude $A_1$ and phase $\theta_1$ in the fundamental frequency $w_0$ using a minimization process as illustrated in Equation 5 about with respect to a first target signal r[n].

The sinusoidal magnitude/phase search unit 143 additionally detects frequency, spectral magnitude, and phase parameters according to each candidate value of $c_l^k$ with respect to candidate values of $c_l^k$ output from the frequency damping factor application unit 145.

An operation of the sinusoidal magnitude/phase search unit 143 with respect to candidate values of $c_l^k$ output from the frequency damping factor application unit 145 will now be described in more detail.

The error minimization block 143*b* searches a sinusoidal magnitude $A_1$ and phase $\tilde{\theta}_1$, which can minimize an error with respect to each frequency of $(1-2a*n)*w_0$, $(1-a*n)*w_0$, $w_0$, $(1+a*n)*w_0$, and $(1+2a*n)*w_0$, using the fundamental frequency $w_0$ and a value a output from the frequency damping factor application unit 145. That is, the five candidate frequencies $(1-2a*n)*w_0$, $(1-a*n)*w_0$, $w_0$, $(1+a*n)*w_0$, and $(1+2a*n)*w_0$ are set by multiplying $c_l^k$ by n/2 (n=0, ±1, ±2) based on a difference of fundamental frequencies of the current frame and the previous frame in Equation 3 above.

For example, if the damping factor a is set to 0, the error minimization block 143*b* obtains the sinusoidal magnitude $A_1$ and phase $\theta_1$, which can minimize an error with respect to the fundamental frequency $w_0$.

Thus, using the above-described method, the error minimization block 143*b* obtains the sinusoidal magnitude $A_1$ and phase $\tilde{\theta}_1$, which can minimize an error with respect to each frequency of $(1-2a*n)*w_0$, $(1-a*n)*w_0$, $w_0$, $(1+a*n)*w_0$, and $(1+2a*n)*w_0$, and provides a pair of a sinusoidal magnitude and a phase $(A_1, \tilde{\theta}_1)$ corresponding to each frequency to the damping factor selector 147.

When the sinusoidal magnitude $A_1$ and phase $\tilde{\theta}_1$ are input, the dictionary element generator block 143*c* generates a sinusoidal dictionary signal $d_l^k$ represented by Equation 8 below and outputs the sinusoidal dictionary signal $d_l^k$ to the accumulator block.

$$d_1^k = \sum_{n=1}^{frame\ size} \tilde{A}_1(n) * \cos(1 * w_0 * n + a * 1 * w_0 * n * n + \tilde{\theta}_1) \tag{8}$$

The value a denotes a phase change rate of a spectrum synthesized by performing $2^{nd}$ order interpolation of a phase of the spectrum of the previous frame and can be represented by Equation 3 above using the frequency damping factor $c_l^k$ input from the frequency damping factor application unit 145.

Thus, the value a is determined according to $c_l^k$ as illustrated in Equation 3 above, and detected frequency points, i.e., $(1-2a*n)*w_0$, $(1-a*n)*w_0$, $w_0$, $(1+a*n)*w_0$, and $(1+2a*n)*w_0$, are calculated according to a.

The accumulator block generates the synthesized signal $\bar{r}_i[n]$ (the signal b in FIG. 3A) by linearly adding $d_l^k$. In this case, the accumulator block 143*d* generates only $d_l^k$. The accumulator block 143*d* outputs the signal $\bar{r}_i[n]$ generated by synthesizing $d_l^k$ in the time domain. The calculator block 143*a* generates the new target signal $r_1$ [n] (the signal c in FIG. 3B) by subtracting the synthesized signal $\bar{r}_i[n]$ (the signal b in FIG. 3A) from the target signal r[n] (the signal a in FIG. 3A), which is the LP residual signal, and performs a next ring operation.

As illustrated in FIG. 3A, both the target signal r[n] (the signal a) and the synthesized signal $\bar{r}_i[n]$ (the signal b) form a peak value in the fundamental frequency $w_0$ and, as illustrated in FIG. 3B, when the magnitude of the new target signal $r_1[n]$ (the signal c) is close to 0 in the fundamental frequency $w_0$, an error value in the fundamental frequency $w_0$ is smaller than the error value in other frequencies.

As described above, if the first ring operation for a search with respect to the fundamental frequency $w_0$ and surrounding frequencies ends, the second ring operation for the new target signal $r_1[n]$ is performed.

Figure 4A:
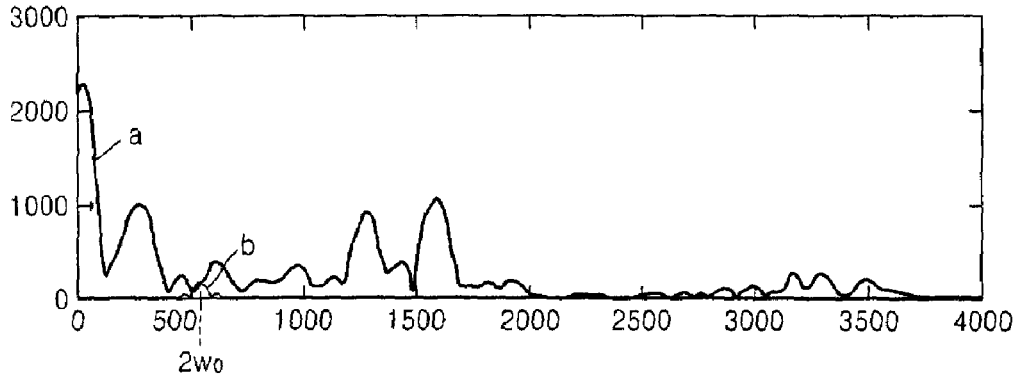
FIGS. 4A and 4B are graphs illustrating a signal waveform and magnitude when the sinusoidal magnitude and phase search unit according to an exemplary embodiment of the present invention has secondly operated its internal blocks in a ring arrangement.
Figure 4B:
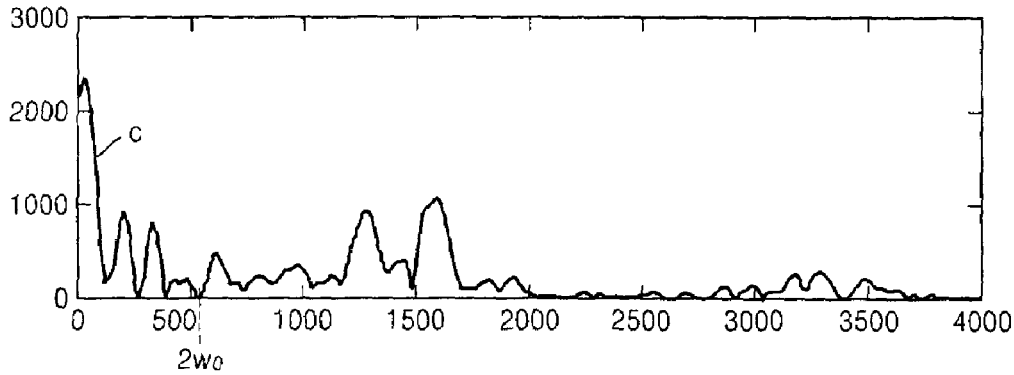

FIGS. 4A and 4B are graphs illustrating a signal waveform and magnitude when the sinusoidal magnitude/phase search unit 143 according to an exemplary embodiment of the present invention has secondly operated its internal blocks in a ring arrangement.

FIG. 4A illustrates the magnitude of the target signal r[n] indicated by the character a, which is the LP residual signal, and the magnitude of a second synthesized signal $\bar{r}_i[n]$ indicated by the character b, which is output from the accumulator block 143*d*, in a frequency domain according to an exemplary embodiment of the present invention. FIG. 4B illustrates the magnitude of a new target signal $r_2[n]$ indicated by the character c in the frequency domain according to an exemplary embodiment of the present invention.

In the second ring operation, a sinusoidal magnitude $A_2$ and phase $\tilde{\theta}_2$, which can minimize an error with respect to a frequency $2*w_0$ corresponding to double the fundamental frequency and surrounding frequencies, are searched.

As well as the first ring operation, in the second ring operation, when the second target signal $r_1[n]$ is input to the error minimization block 143*b*, the frequency $2*w_0$ corresponding to double the fundamental frequency is simultaneously input to the error minimization block 143*b* by means of the pitch search.

The error minimization block 143*b* obtains the sinusoidal magnitude $A_2$ and phase $\tilde{\theta}_2$ in the frequency $2*w_0$ and surrounding frequencies by means of the minimization process as illustrated in Equation 5 above with respect to the second target signal $r_1[n]$ and outputs the sinusoidal magnitude $A_2$ and phase $\tilde{\theta}_2$ to the dictionary element generator block 143*c*.

That is, like in the first ring operation, the error minimization block 143*b* searches the sinusoidal magnitude $A_2$ and phase $\tilde{\theta}_2$, which can minimize an error with respect to each frequency of $(1-2a*n)*w_0$, $(1-a*n)*w_0$, $w_0$, $(1+a*n)*w_0$, and $(1+2a*n)*w_0$, using the damping factor value a.

When the sinusoidal magnitude $A_2$ and phase $\tilde{\theta}_2$ are input, the dictionary element generator block 143*c* generates a sinusoidal dictionary $d_2^k$ represented by Equation 9 below and outputs the sinusoidal dictionary $d_2^k$ to the accumulator block 143*d*.

$$d_2^k = \sum_{n=1}^{frame\ size} \tilde{A}_2(n) * \cos(2 * w_0 * n + a * 2 * w_0 * n * n + \tilde{\theta}_2) \tag{9}$$

In this case, like in the first ring operation, the sinusoidal dictionary $d_2^k$ varies according to the found sinusoidal magnitude $A_2$ and phase $\tilde{\theta}_2$.

The accumulator block 143*d* generates a synthesized signal by linearly adding $d_l^k$ and accumulates the temporal waveform $d_1^k$ generated in the first ring operation and the temporal waveform $d_2^k$ generated in the second ring operation.

Thus, the accumulator block 143*d* outputs the synthesized signal $\bar{r}_i[n]$ generated in the time domain from $d_1^k+d_2^k$.

Likewise, in a third ring operation, a third target signal $r_2[n]$ (signal c in FIG. 4B) is generated by subtracting the synthesized signal $\bar{r}_i[n]$ (signal b in FIG. 4A) from the target signal r[n] (signal a in FIG. 4A).

As illustrated in 4A, a peak value of a spectrum of the first target signal r[n] may not match a peak value of a spectrum of the signal $d_2^k$ in the frequency $2*w_0$. Thus, the error minimization block 143*b* obtains the sinusoidal magnitude $A_2$ and phase $\tilde{\theta}_2$, which can minimize an error with respect to each frequency of $(1-2a*n)*2*w_0$, $(1-a*n)*2*w_0$, $2*w_0$, $(1+a*n)*2*w_0$, and $(1+2a*n)*2*w_0$, and provides a pair of a sinusoidal magnitude and a phase $(A_2, \tilde{\theta}_2)$ corresponding to each frequency to the damping factor selector 147.

That is, if the LP residual signal forms a peak value at a location approximately corresponding to an integer multiple of the fundamental frequency $w_0$ without forming a peak value at an integer multiple of the fundamental frequency $w_0$, discontinuity between frames occurs, and thus in order to prevent the discontinuity, frequencies corresponding to a peak are searched to reduce an error as much as possible.

Thus, a new signal is generated by subtracting a signal obtained by synthesizing parameters analyzed at a frequency corresponding to two times the fundamental frequency from the target signal in the second ring operation, a new signal is generated again by subtracting a signal obtained by synthesizing parameters analyzed at a frequency corresponding to three times the fundamental frequency from the target signal in the third ring operation, and this process is repeated.

In this manner, if a number of rotations corresponding to the number l of spectra of the first target signal r[n] are performed, pairs of sinusoidal magnitude and phase with respect to surrounding frequencies of frequencies that are an integer multiple of the fundamental frequency $w_0$ are input to and stored in the damping factor selector 147.

The number of spectra is calculated by dividing the pitch obtained by the integer pitch search unit 130 and the fractional pitch search unit 150 illustrated in FIG. 1 as represented by Equation 10.

$$H_{num} = \frac{p}{2} \tag{10}$$

In Equation 10, $H_{num}$ denotes the number of spectra, and p denotes a pitch period.

The damping factor selector 147 obtains a power value of a final residual signal according to each frequency, selects an optimal frequency damping factor $c_l^k$ at which the power value is minimized, and outputs $A_k$ and $\tilde{\theta}_k$ corresponding to the optimal frequency damping factor $c_l^k$ to the damping factor synthesizer 149.

That is, if a number of rotations corresponding to the number l of spectra has been finally performed, the accumulator block outputs $\ddot{r}_l[n]=d_1^k+d_2^k+\ldots+d_l^k$, and the calculator block generates a final target signal $r_{l+1}[n]$ by subtracting $\ddot{r}_l[n]$ from the first target signal r[n].

The final target signal $r_{l+1}[n]$ can be a final residual signal obtained by subtracting synthesized signals from the first target signal r[n] by means of rotations until the present moment.

That is, the matching pursuit algorithm of the sinusoidal magnitude/phase search unit 143 is performed repeatedly as many times as a number of spectra of a method of generating a target signal, by subtracting a sinusoidal dictionary of a frequency having the maximum energy from an original signal and synthesizing a new target signal by subtracting a sinusoidal dictionary of a frequency having the second maximum energy from the target signal.

In this case, since a number of rotations corresponding to the number l of spectra is performed, $A_k$ and $\tilde{\theta}_k$ at which $E_k$ is minimized, which corresponds to each of $c_l^k$, is generated a number of times corresponding to the number l of spectra.

$A_l$ and $\tilde{\theta}_l$ at which $E_k$ is minimized are stored in the damping factor selector 147 together with each damping factor $c_l^k$.

The damping factor selector 147 obtains a power value of a final residual signal remaining finally according to each candidate of $c_l^k$, selects optimal parameters at which the power value is minimized, and outputs the optimal parameters to the damping factor synthesizer 149.

The damping factor synthesizer 149 synthesizes an LP residual signal using the optimal parameters obtained using the repeated matching pursuit algorithm.

The LP residual signal synthesized by the damping factor synthesizer 149 is a signal synthesized using the optimal frequency damping factor $c_l^k$ and a spectral magnitude and phase in a corresponding frequency. Here, since the spectral magnitude damping factor $g_l^k$ is fixed to 1, the spectral magnitude damping factor $g_l^k$ is not considered, and thus only the frequency damping factor $c_l^k$ is considered.

The damping factor selector 147 obtains a sinusoidal magnitude $A_l$ and phase $\tilde{\theta}_1$, which can minimize an error with respect to each frequency of $(1-2a*n)*l*w_0$, $(1-a*n)*l*w_0$, $l*w_0$, $(1+a*n)*l*w_0$, and $(1+2a*n)*l*w_0$, from the final target signal $r_{l+1}[n]$ and stores a pair of a sinusoidal magnitude and a phase $(A_l, \tilde{\theta}_l)$ corresponding to each frequency.

The damping factor selector 147 finally obtains a power value of a final residual signal with respect to each of the 5 frequency damping factors $c_l^k$ selects an optimal frequency damping factor $c_l^k$ at which the power value is minimized, and outputs $A_l$ and $\tilde{\theta}_l$ corresponding to the optimal frequency damping factor $c_l^k$ to the damping factor synthesizer 149.

The power value is obtained by squaring a spectrum of the residual signal.

The damping factor synthesizer 149 receives the optimal frequency damping factor $c_l^k$ and the $A_l$ and $\tilde{\theta}_l$ corresponding to the optimal frequency damping factor $c_l^k$ and synthesizes an LP residual signal using Equation 11.

$$\hat{r}(n) = \sum_{l=1}^{frame\,size} A_l \cos\left((lw_0 + c_0)n + \tilde{\theta}_l\right) \tag{11}$$

Here, the mark as the upper subscript (i.e., the r hat) indicates the magnitude and phase of a spectrum considering the influence of the damping factor.

The damping factor synthesizer 149 also determines the spectral magnitude damping factor $g_l^k$ using Equations 12 through 14 shown below. Here, $g_0^k$ is estimated by assuming that $g_l^k$ is $g_0^k$ considering the constraints of a data rate.

$$\begin{aligned}\zeta(n, g_0^k) &= \left(\sum_{n=1}^{N}\left(s^k - \hat{s}^k(n, g_0^k, c_0^k)\right)^2\right) \\ &= \left(\sum_{n=1}^{N}\left(s^k(n) - \frac{(1-(1-g_0^k))\cdot n}{N}\hat{v}(n, c_0^k)\right)^2\right)\end{aligned} \tag{12}$$

$$\text{where, } \hat{v}(n, c_0^k) = \sum_{l=1}^{L^k} A_l^k \cdot \mathrm{Re}[e^{j\theta_l^k(n, c_l^k)}]$$

Finally, since an optimal solution of $g_0^k$ is obtained when $$\frac{\partial \zeta(n, g_0^k)}{\partial g_0^k} = 0,$$

Equation 12 is arranged as Equation 13.

$$\frac{\partial \zeta(n, g_0^k)}{\partial g_0^k} = \frac{\partial}{\partial g_0^k}\left(\sum_{n=1}^{N}\left(s^k(n) - \frac{(1-(1-g_0^k))n}{N}\hat{v}(n, c_0^k)\right)^2\right) \tag{13}$$

Thus, Equation 12 is arranged for $g_0^k$ as Equation 14.

$$g_0^k = \frac{\sum_{n=1}^{N}\left(\frac{N-n}{N}\left(\hat{v}(n, c_0^k)\right)^2 - \frac{n}{N}s^k(n)\cdot\hat{v}(n, c_0^k)\right)}{\sum_{n=1}^{N}\left(\left(\frac{n}{N}\right)^2\left(\hat{v}(n, c_0^k)\right)^2\right)} = N\left(\frac{\sum_{n=1}^{N} n\cdot s^k(n)\cdot\hat{v}(n, c_0^k)}{\sum_{n=1}^{N}\left(n\cdot\hat{v}(n, c_0^k)\right)^2} - \frac{\sum_{n=1}^{N} n\cdot(\hat{v}(n, c_0^k))}{\sum_{n=1}^{N}(n\cdot\hat{v}(n, c_0^k))} + 1\right) \tag{14}$$

These finally estimated parameters, i.e., the spectral magnitude and phase and damping factors $g_0^k$ and $c_0^k$, are used for a sinusoidal synthesis formula.

That is, a discontinuous voice signal is improved by adjusting a position of each peak pulse using the frequency damping factor $c_l^k$, a slope between the magnitude of the last peak pulse of a previous frame and the magnitude of the first peak pulse of a current frame to be linear using the spectral magnitude damping factor $g_0^k$, and a slope between peak pulses of each current frame.

A method used by the phase/spectral magnitude quantizer 160 to quantize a spectral magnitude and damping factor of an LP residual signal output from the sinusoidal analyzer 140 will now be described in more detail with reference to FIGS. 5A and 5B.

The phase/spectral magnitude quantizer 160 includes a spectral magnitude quantizer 160*a* and a phase quantizer 160*b*.

Figure 5A:
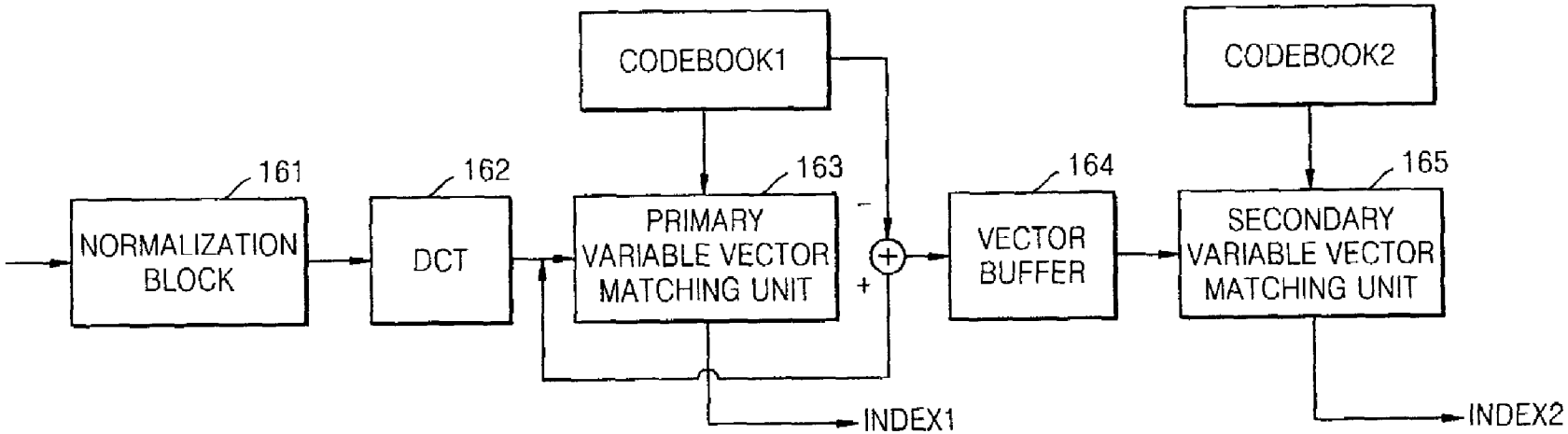
FIGS. 5A and 5B are block diagrams of an encoder end and a decoder end of a spectral magnitude quantizer according to an exemplary embodiment of the present invention.
Figure 5B:
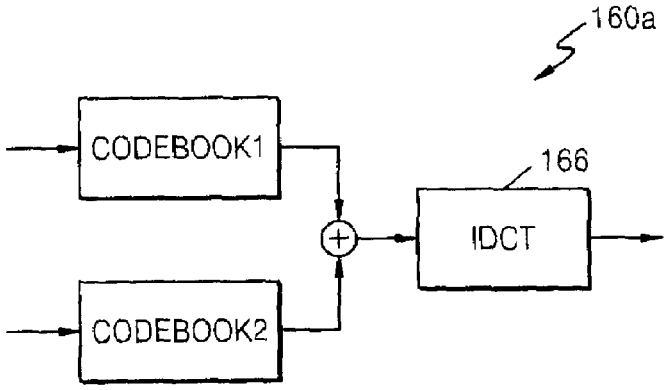

FIGS. 5A and 5B are block diagrams of an encoder end and a decoder end of the spectral magnitude quantizer 160*a* according to an exemplary embodiment of the present invention.

Referring to FIG. 5A, the encoder end of the spectral magnitude quantizer 160*a* includes a normalization block 161, a Discrete Cosine Transform (DCT) block 162, a primary variable vector matching unit 163, a vector buffer 164, and a secondary variable vector matching unit 165.

The number of harmonic magnitude values is about 6-120, and in order to quantize this variable number of spectral magnitudes (harmonic values and non-harmonic values), a DCT function is used. Transformed DCT values are quantized by a split vector quantization method and a multi-stage vector quantization method. According to an analysis process of a DCT quantizer, the number of harmonics is obtained using Equation 10 above.

The normalization block 161 normalizes each spectral magnitude using mean energy of the spectral magnitude as illustrated in Equation 15 below. The normalization is performed to reduce a variation range of the spectral magnitudes to within a threshold range for quantization efficiency since a variation range of spectral magnitudes detected according to energy of a voice signal is large. The threshold range may be predetermined.

$$H_{norm}(n) = \frac{H(n)}{\sqrt{\sum_{i=1}^{H_{num}}\frac{H(i)\cdot H(i)}{H_{num}}}} \tag{15}$$

The DCT block 162 transforms the normalized spectral values using Modified DCT (MDCT) as illustrated in Equation 16.

$$S(k) = \sum_{n=0}^{N} H_{norm}(n)\lambda(k)\cos\left[\frac{(2n+1)\pi k}{2N}\right] \tag{16}$$

$$\lambda(k) = \begin{cases} 1; & k = 0 \\ \sqrt{2}; & \text{otherwise} \end{cases}$$

The primary variable vector matching unit 163 selects N candidate vectors from a codebook1 so that an Euclidean distance between DCT coefficients is minimized and stores the N candidate vectors in the vector buffer 164.

The secondary variable vector matching unit 165 obtains difference values between the N candidate vectors, selects N codebook candidate vectors from a codebook2, and finally selects a codebook candidate vector of which a Euclidean distance with an original DCT coefficient is minimized.

Referring to FIG. 5B, the decoder end of the spectral magnitude quantizer 160*a* includes an Inverse DCT (IDCT) block 166, and the IDCT block 166 obtains an inversely quantized value and an original spectral magnitude by performing Inverse MDCT (IMDCT) of a codebook value of codebook1 and codebook2 selected by the decoder end.

A method of quantizing a phase among the parameters extracted using the matching pursuit sinusoidal model to which a damping factor is added will now be described with reference to FIG. 6

Figure 6:
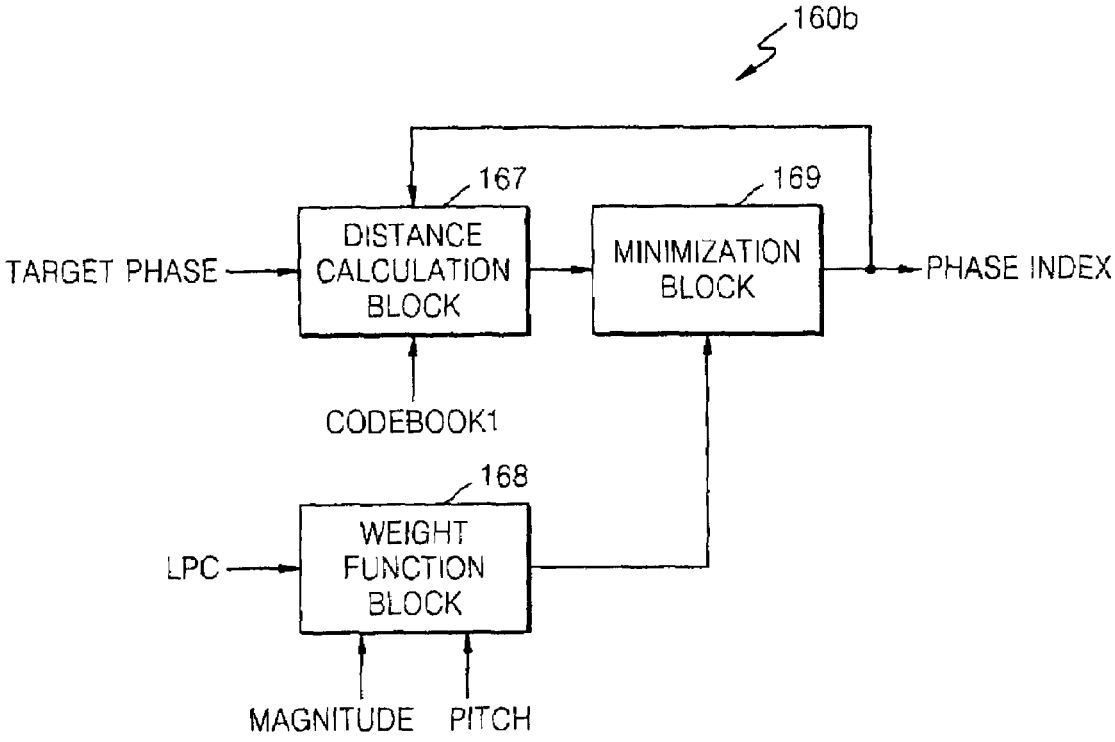
FIG. 6 is a block diagram of a phase quantizer according to an exemplary embodiment of the present invention.

FIG. 6 is a block diagram of the phase quantizer 160*b* according to an exemplary embodiment of the present invention.

Referring to FIG. 6, the phase quantizer 160*b* includes a distance calculation block 167, a weight function block 168, and a minimization block 169.

Although the phase quantizer 160*b* is shown as a quantizer of one stage, a transmission rate may be adjusted by connecting two or more quantizers in parallel to reduce a quantization error of a previous stage or adjust the number of quantized phases. That is, the number of quantized phases varies for each transmission rate, and a phase quantization error occurring for each transmission rate is also quantized.

The distance calculation block 167 receives a target phase and obtains a distance between the target phase and a codebook phase generated from the target phase. That is, in all types of vector quantization, a method of searching for a quantization value having the minimum difference between codebook indexes of a target signal to be quantized and quantized signals is used. This is because a quantization error is minimized since the quantization value having the minimum difference is most similar to the target phase.

An error in each dimension is a maximum of $2\pi$ according to scalar quantization on a perpendicular line. However, if an error is obtained on polar coordinates using a modular $2\pi$ rotation characteristic of a phase, the maximum error is $\pi$. By using this rotation characteristic of a phase, the number of bits can be efficiently reduced. A correlation between a target quantization signal and a codebook phase is represented as Equations 17 and 18.

$$\text{phase}_{tar}(n)=\text{phase}_{code1}(n)+\text{phase}_{error0}(n) \tag{17}$$

$$\text{phase}_{error0}(n)=\text{phase}_{code2}(n)+\text{phase}_{error1}(n) \tag{18}$$

Here, $\text{phase}_{tar}(n)$ denotes a target phase of an $n^{th}$ dimension, $\text{phase}_{code1}(n)$ denotes a $1^{st}$ stage codebook phase of the $n^{th}$ dimension, and $\text{phase}_{error0}(n)$ denotes a $1^{st}$ stage error phase of the $n^{th}$ dimension. In order to represent $\text{phase}_{tar}(n)$ as in Equation 15, it is advantageous for $\text{phase}_{error0}(n)$ to be represented differently according to signs of a target signal and a codebook index as in Equation 16. This correlation is represented by Equation 19.

$$phase_{error0} = \begin{cases} phase_{tar} > 0,\ phase_{code} > 0;\ phase_{tar}(n) - phase_{code1}(n) \\ phase_{tar} > 0,\ phase_{code} < 0;\ |phase_{error0}(n)| - 2\pi \\ phase_{tar} < 0,\ phase_{code} > 0;\ 2\pi - |phase_{error0}(n)| \\ phase_{tar} < 0,\ phase_{code} < 0;\ phase_{tar}(n) - phase_{code1}(n) \end{cases} \tag{19}$$

In addition, with the rotation characteristic of a phase, the design of a weighting filter is used in order to represent a synthesized voice as a voice most similar to an input voice in the time domain by changing an error weight in a phase codebook according to a spectral magnitude of the input voice. The weight function block 168 obtains a weight function PW(N) with respect to a phase having the same dimension using an envelope value according to an LPC coefficient and a spectral magnitude of an LP residual signal.

The minimization block 169 searches an optimal phase index using the weight function received from the weight function block 168 and a Mean Square Error (MSE) obtained from Equation 20 below and transmits the optimal phase index to the MUX 190.

$$\text{MSE}=PW^2(N)(\text{phase}_{tar}(n)-\text{phase}_{code}(n))^2 \tag{20}$$

Here, PW(N) denotes a spectral magnitude of an input voice signal of the $n^{th}$ dimension, and $\text{phase}_{code}(n)$ denotes a synthesized phase synthesized by the codebook.

As described above exemplary embodiments of the present invention relate to a sinusoidal model expanded to provide a matching pursuit method having a good frequency resolution for efficient sinusoidal modeling of a voice signal, and a broadband voice encoder using the expanded sinusoidal model. In addition, in order to efficiently quantize parameters of the expanded sinusoidal model, a harmonic quantizer using DCT and a rotation weight phase quantizer are used. In addition, signal to noise (SNR) expandability can be supported by transmitting parameter quantization errors of all stages or increasing the number of parameters according to a stage.

The present inventive concept can also be embodied as a computer program. The codes and code segments for embodying the computer program may be easily construed by programmers in the art to which the present inventive concept belongs. An exemplary embodiment of the computer program according to the present invention embodies the method of encoding/decoding a broadband voice signal by being stored in a computer readable recording medium and thereafter read and executed by a computer system. Examples of the computer readable recording medium include magnetic recording media, optical recording media, and carrier wave media.

As described above, a method of encoding/decoding a broadband voice signal according to an exemplary embodiment of the present invention is advantageous to high sound quality and low complexity because it addresses the problem of discontinuity between frames and distortion of a voice waveform occurring in an existing sinusoidal model and minimizes a quantization error. In addition, by providing a SNR expansion function, optimal communication in a given channel environment can be performed.

While the present inventive concept has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A method performed on a coding apparatus, the method comprising:

extracting a linear prediction coefficient (LPC) from a broadband voice signal;

removing, using a processor of the coding apparatus, an envelope from the broadband voice signal using the LPC to obtain a linear prediction (LP) residual signal;

pitch-searching a spectrum of the LP residual signal;

extracting a plurality of spectral magnitudes and phases of the LP residual signal, which correspond to a damping factor, by adding the damping factor to a matching pursuit algorithm;

obtaining, from among the extracted plurality of spectral magnitudes and phases, a first spectral magnitude and a first phase at which a power value of the LP residual signal is minimized; and quantizing the first spectral magnitude and the first phase, wherein the damping factor is determined according to a ratio of a parameter of a current frame to a parameter of a previous frame, and wherein the extracting the plurality of spectral magnitudes and phases of the LP residual signal comprises:

setting a plurality of candidate frequencies derived from the frequencies obtained by pitch-searching the LP residual signal using the frequency damping factor;

calculating a sinusoidal dictionary value by obtaining, from among the plurality of candidate frequencies, a frequency and a phase at which an error value is minimized, with respect to each frequency obtained by pitch-searching, and accumulating the sinusoidal dictionary value calculated with respect to each frequency obtained by pitch-searching;

generating a final residual signal by subtracting the accumulated sinusoidal dictionary value from a target signal, which is the LP residual signal; and detecting a frequency damping factor which corresponds to the first spectral magnitude and the first phase at which a power value of the final residual signal is minimized with respect to each frequency obtained by pitch-searching.

2. The method of claim 1, further comprising decoding the broadband voice signal.

3. The method of claim 1, wherein the setting of the plurality of candidate frequencies comprises setting the plurality of candidate frequencies between a frequency corresponding to (n−1) times a fundamental frequency and a frequency corresponding to (n+1) times the fundamental frequency using the frequency damping factor with respect to a frequency corresponding to n times the fundamental frequency in the LP residual signal.

4. The method of claim 3, wherein a number of the accumulated sinusoidal dictionaries is equal to a number of spectra of the broadband voice signal.

5. The method of claim 1, wherein the spectral magnitude damping factor is obtained and quantized using the first spectral magnitude and the first phase.

6. The method of claim 5, wherein the first spectral magnitude is quantized using Discrete Cosine Transformation (DCT).

7. The method of claim 6, wherein quantizing the first phase comprises:

obtaining a first plurality of distances by obtaining a first plurality of differences between the first phase and first codebook phases generated from the first phase, multiplying the first plurality of differences by an envelope value corresponding to the first phase to generate a plurality of multiplication results, and adding each of the first plurality of differences to a respective one of the first plurality of multiplication results;

detecting and outputting a first codebook phase allowing a distance among the first plurality of distances to be minimized;

generating a second phase by adjusting a phase error vector generated from a difference between the first codebook phase and the first phase, and obtaining a second plurality of distances by obtaining a second plurality of differences between the second phase and second codebook phases generated from the second phase, multiplying the second plurality of differences by an envelope value corresponding to the second phase to generate a second plurality of multiplication results, and adding each of the second plurality of differences to a respective one of the second plurality of multiplication results; and detecting and outputting a second codebook phase allowing a distance among the second plurality of distances to be minimized.

8. The method of claim 7, wherein the damping factor, the spectral magnitude, the phase, and a pitch are quantized by determining bit assignment based on mode information according to various transmission rates.

9. The method of claim 5, wherein the decoding of the broadband voice signal comprises:

decoding the quantized first spectral magnitude and the quantized first phase;

decoding the quantized damping factor;

synthesizing the LP residual signal using at least one of the first spectral magnitude, the first phase, the damping factor, and a pitch value; and decoding the broadband voice signal from the LP residual signal.

10. The method according to claim 1, wherein the damping factor comprises a spectral magnitude damping factor which comprises a ratio of a spectral magnitude parameter of a current frame to a spectral magnitude parameter of a previous frame, and a frequency damping factor which comprises a ratio of a frequency parameter of a current frame to a frequency parameter of a previous frame.

11. The method of claim 1, wherein the step of pitch-searching comprising;

integer pitch-searching a spectrum of the LP residual signal; and fractional pitch-searching a spectrum of the LP residual signal.

12. The method of claim 1, wherein the pitch-searching uses an open-loop pitch search.

13. An encoder for encoding a broadband voice signal in a broadband voice encoding system, the encoder including at least one central processing unit (CPU), the encoder comprising:

a linear prediction coefficient (LPC) analyzer which extracts, using the at least one CPU, an LPC from the broadband voice signal;

an LPC inverse filter which outputs a linear prediction (LP) residual signal obtained by removing an envelope from the broadband voice signal using the LPC;

a pitch searching unit which pitch-searches a spectrum of the LP residual signal;

a sinusoidal analyzer which extracts a plurality of spectral magnitudes and phases of the LP residual signal, which correspond to a damping factor, by adding the damping factor to a matching pursuit algorithm, and obtains a first spectral magnitude and a first phase, at which a power value of the LP residual signal is minimized, from among the extracted plurality of spectral magnitudes and phases; and a phase and spectral magnitude quantizer which quantizes the first spectral magnitude and the first phase, wherein the damping factor is determined according to a ratio of a parameter of a current frame to a parameter of a previous frame, and wherein the sinusoidal analyzer comprises:

a frequency damping factor application unit which sets a plurality of candidate frequencies derived from the frequencies obtained by pitch-searching the LP residual signal using the frequency damping factor;

an error minimization unit which obtains a frequency and a phase, at which an error value is minimized, from among the plurality of candidate frequencies with respect to each frequency obtained by pitch-searching;

a dictionary component generator which obtains a sinusoidal dictionary value based on the frequency and the phase output from the error minimization unit;

an accumulator which receives the sinusoidal dictionary value generated with respect to each frequency obtained by pitch-searching the dictionary component generator and accumulates the sinusoidal dictionary value;

a calculator which generates a final residual signal by subtracting the accumulated sinusoidal dictionary value from the LP residual signal; and a damping factor selector which detects a frequency damping factor which corresponds to the first spectral magnitude and the first phase at which a power value of the final residual signal is minimized with respect to each frequency obtained by pitch-searching.

14. The encoder of claim 13, wherein the frequency damping factor application unit sets the plurality of candidate frequencies between a frequency corresponding to (n−1) times a fundamental frequency and a frequency corresponding to (n+1) times the fundamental frequency using the frequency damping factor with respect to a frequency corresponding to n times the fundamental frequency in the LP residual signal.

15. The encoder of claim 14, wherein a number of the accumulated sinusoidal dictionaries is equal to a number of spectra of the broadband voice signal.

16. The encoder of claim 13, further comprising a damping factor synthesizer which obtains the spectral magnitude damping factor using the first spectral magnitude and the first phase.

17. The encoder of claim 16, wherein the phase and spectral magnitude quantizer quantizes the first spectral magnitude using a Discrete Cosine Transformation (DCT).

18. The encoder of claim 17, wherein the phase and spectral magnitude quantizer comprises:

a distance calculation block which obtains a distance by obtaining a plurality of differences between the first phase and a plurality of first codebook phases generated from the first phase, multiplying the plurality of differences by an envelope value corresponding to the first phase to generate a plurality of multiplication results, and adding each of the plurality of differences to a respective one of the plurality of multiplication results;

a minimization block which detects a first codebook phase allowing the distance to be minimized and outputs a second phase by applying a weight function to a phase error vector generated from a difference between the first codebook phase and the first phase that corresponds to the minimized distance; and a weight function block which outputs the weight function of the spectral magnitude and a pitch to the minimization block.

19. The encoder of claim 18, wherein a plurality of phase and spectral magnitude quantizers coupled together in parallel quantize the first phase.

20. The encoder of claim 18, wherein the apparatus quantizes the damping factor, the spectral magnitude, the phase, and a pitch by determining a bit assignment based on mode information according to various transmission rates.

21. The encoder according to claim 13, wherein the damping factor comprises a spectral magnitude damping factor which comprises a ratio of a spectral magnitude parameter of a current frame to a spectral magnitude parameter of a previous frame, and a frequency damping factor which comprises a ratio of a frequency parameter of a current frame to a frequency parameter of a previous frame.

22. A broadband voice encoding and decoding system comprising:

a broadband voice encoder which includes at least one central processing unit (CPU) and obtains a linear prediction (LP) residual signal by removing an envelope from a broadband voice signal using a linear prediction coefficient (LPC) extracted from the broadband voice signal, extracts a plurality of spectral magnitudes and phases of the LP residual signal, which correspond to a damping factor, by adding the damping factor to a matching pursuit algorithm, obtains a first spectral magnitude and a first phase, at which a power value of the LP residual signal is minimized, from among the extracted plurality of spectral magnitudes and phases, and quantizes the first spectral magnitude and the first phase, wherein the damping factor is determined according to a ratio of a parameter of a current frame to a parameter of a previous frame; and a broadband voice decoder which decodes the broadband voice signal by decoding the quantized first spectral magnitude, the quantized first phase, and the quantized damping factor and synthesizing the LP residual signal, and wherein the extracting the plurality of spectral magnitudes and phases of the LP residual signal of the broadband voice encoder comprises:

setting a plurality of candidate frequencies derived from the frequencies obtained by pitch-searching the LP residual signal using the frequency damping factor;

calculating a sinusoidal dictionary value by obtaining, from among the plurality of candidate frequencies, a frequency and a phase at which an error value is minimized, with respect to each frequency obtained by pitch-searching, and accumulating the sinusoidal dictionary value calculated with respect to each frequency obtained by pitch-searching;

generating a final residual signal by subtracting the accumulated sinusoidal dictionary value from a target signal, which is the LP residual signal; and detecting a frequency damping factor which corresponds to the first spectral magnitude and the first phase at which a power value of the final residual signal is minimized with respect to each frequency obtained by pitch-searching.

23. A non-transitory computer readable storage medium storing a computer readable program for executing a method comprising:

extracting a linear prediction coefficient (LPC) from the broadband voice signal;

removing an envelope from the broadband voice signal using the LPC to obtain a linear prediction (LP) residual signal;

pitch-searching a spectrum of the LP residual signal;

extracting a plurality of spectral magnitudes and phases of the LP residual signal, which correspond to a damping factor, by adding the damping factor to a matching pursuit algorithm;

obtaining, from among the extracted plurality of spectral magnitudes and phases, a first spectral magnitude and a first phase at which a power value of the LP residual signal is minimized; and quantizing the first spectral magnitude and the first phase, wherein the damping factor is determined according to a ratio of a parameter of a current frame to a parameter of a previous frame, and wherein the extracting the plurality of spectral magnitudes and phases of the LP residual signal comprises:

setting a plurality of candidate frequencies derived from the frequencies obtained by pitch-searching the LP residual signal using the frequency damping factor;

calculating a sinusoidal dictionary value by obtaining, from among the plurality of candidate frequencies, a frequency and a phase at which an error value is minimized, with respect to each frequency obtained by pitch-searching, and accumulating the sinusoidal dictionary value calculated with respect to each frequency obtained by pitch-searching;

generating a final residual signal by subtracting the accumulated sinusoidal dictionary value from a target signal, which is the LP residual signal; and detecting a frequency damping factor which corresponds to the first spectral magnitude and the first phase at which a power value of the final residual signal is minimized with respect to each frequency obtained by pitch-searching.

24. The non-transitory computer readable recording medium according to claim 23, wherein the method further comprises decoding the broadband voice signal.

* * * * *